US005742877A

United States Patent [19]

Okada et al.

[11] Patent Number: 5,742,877

[45] Date of Patent: Apr. 21, 1998

[54] TONER CARTRIDGE SEALING FILM RETAINING CONFIGURATION

[75] Inventors: Mitsuharu Okada; Toshinori Nishimura, both of Osaka, Japan

[73] Assignee: Mita Industrial Co.,Ltd., Osaka, Japan

[21] Appl. No.: 609,311

[22] Filed: Mar. 1, 1996

[30] Foreign Application Priority Data

Mar. 7, 1995 [JP] Japan ..... 7-047473
Jul. 31, 1995 [JP] Japan ..... 7-195076

[51] Int. Cl.[6] ..... G03G 15/08

[52] U.S. Cl. ..... 399/106

[58] Field of Search ..... 399/102, 103, 399/105, 106, 119, 120, 262, 258, 27; 222/DIG. 1

[56] References Cited

U.S. PATENT DOCUMENTS

| | | | |
|---|---|---|---|
| 3,999,654 | 12/1976 | Pollack . | |
| 4,827,307 | 5/1989 | Zoltner | 399/106 |
| 4,937,628 | 6/1990 | Cipolla et al. | 399/106 |
| 5,142,335 | 8/1992 | Sakata et al. | 399/262 X |
| 5,261,568 | 11/1993 | Corby et al. | 399/106 X |

FOREIGN PATENT DOCUMENTS

| | | |
|---|---|---|
| 0 583 019 | 2/1994 | European Pat. Off. . |
| 93 13 184.4 | 12/1993 | Germany . |

OTHER PUBLICATIONS

Patent Abstracts of Japan vol. 94, No. 012, & JP-A-06 332312, Dec. 1994.

Patent Abstracts of Japan vol. 007, No. 087 (P-190), Apr. 9, 1983 & JP-A-58 014864, Jan. 1993.

*Primary Examiner*—Shuk Lee
*Attorney, Agent, or Firm*—Shinjyu Office of Patent Attorney

[57] ABSTRACT

In a toner cartridge for supplying toner to the developing unit in a xerographic image forming apparatus, the casing containing toner has two toner discharge openings sealed prior to installation by a sealing film having a sealing portion peel-separably affixed to the casing around the toner discharge openings, as well as a peel-separating leader portion. The sealing film overlaps itself, having open opposite lateral edges. The toner cartridge is fitted with retaining elements affixed to the casing along opposite lateral edges of the toner discharge openings, for covering the open opposite lateral edges of the sealing film. An installation seat having a toner-disgorging opening corresponding to the toner discharge openings is fixed to the end of the toner cartridge casing. The installation seat includes pressing elements therein disposed over the retaining elements for maintaining external pressure on the retaining elements.

18 Claims, 8 Drawing Sheets

TONER CARTRIDGE SEALING FILM RETAINING CONFIGURATION

BACKGROUND OF THE INVENTION

1. Technical Field

The present invention relates to toner cartridges in xerographic image reproducing apparatuses. In particular, the invention relates to the toner cartridge seals that are removed when the cartridge is fitted to a toner hopper for supplying toner to the developing unit of a xerographic image forming apparatus.

2. Description of Related Art

In xerographic image forming devices such as photocopiers and the like, generally an original document is scanned by an exposing station to form a corresponding electrostatic latent image on a photosensitive drum- A developing unit is provided along the periphery of the photosensitive drum for developing the electrostatic latent image to form a toner image on the photosensitive drum.

A toner hopper for supplying toner is provided in the developing unit. A freely attachable/removable toner cartridge is fitted to the toner hopper, and toner is replenished by replacing the toner cartridge.

The toner cartridge is composed of a casing having a toner discharge opening in the surface which is fitted to the toner hopper, and toner is housed inside this casing. A sealing film is peel-separably adhered to the discharge opening of the toner cartridge, such that the toner within is sealed off. One end of the sealing film is provided extending and folded back, making it withdrawable in the direction from the other end.

When a toner cartridge is fitted to the toner hopper, the sealing film fixed to the casing is peeled away by withdrawing the folded-back end of the sealing film, and the toner discharge opening of the casing is opened facing into the toner hopper. Consequently, the toner inside the toner cartridge is supplied into the toner hopper.

The toner discharge opening of the toner cartridge is open usually directed downwards. Consequently, when a toner cartridge is fitted to the toner hopper and the sealing film is peeled away, the toner inside the toner cartridge drops into the toner hopper. The toner is in a finely powdered form, and accompanying its drop into the hopper is its scattering within the atmosphere inside the hopper.

Until the sealing film is completely peeled away, the fixed portion and the folded back portion are overlapped in the vicinity of the toner discharge opening. Consequently, in the process of peeling away the sealing film, a gap occurs between the fixed portion and the folded back portion of the sealing film. Therefore, there is a danger that the toner scattered within the atmosphere inside the toner hopper will invade the gap between the overlapping fixed and folded-over portions along the rim of the sealing film.

In particular, the weight of toner housed increases with larger-model toner cartridges. For this reason, there exist casings provided with a plurality of toner discharge openings, with sealing films attached to each, to disperse the load applied to each sealing film. In this case, the rims along the sealing films are positioned in the central part of the toner cartridge, and there is a particular danger that invasion of toner will increase.

There is a danger that toner which has invaded the gap in the sealing film will be scattered outside the toner cartridge and toner hopper when the sealing film has been completely peeled away, and will contaminate other parts of the image forming apparatus.

Toner also sticks to the inner surface of the portion of the sealing film that had been sealing the toner discharge opening. When the sealing film is peeled away by withdrawing the folded-back portion of the sealing film, the portion to which toner has stuck is thus withdrawn while being exposed to the exterior. A film cleaning element is sometimes provided separated from the casing by a gap through which the sealing film can pass so that the image forming apparatus is not contaminated by the toner stuck to the sealing film. In this case, one of the surfaces of the sealing film which is peeled away is withdrawn in continuous contact with the film cleaning element. As a consequence, the toner stuck to the surface of the sealing film is removed by the film cleaning element.

In order to remove toner stuck to the surface of the sealing film, it is necessary to make the gap between the film cleaning element and the casing extremely small. In the process of peeling away the sealing film in the manner mentioned above, when toner invades the gap in the sealing film, there is a danger that the added thickness of the toner which has invaded can make it impossible for the sealing film to pass through the gap between the film cleaning element and the casing.

Various configurations have been considered for peel-separating the sealing film, such as one in which the operator proceeds to peel the sealing film off by withdrawing an end, another in which one end of the sealing film is fixed to a rotatable shaft that is turned by manually operating a handle, or in which this shaft is automatically turned by a motor, etc. The problematic points mentioned above are involved in any of these cases.

SUMMARY OF THE INVENTION

An object of the present invention is to prevent the invasion of toner into the gap between the fixed portion and the folded back portion of the sealing film and to prevent the scattering of toner and faulty peel-separation of the sealing film when the sealing film sealing the toner discharge opening of a toner cartridge is peeled away.

In one aspect of the present invention, a toner cartridge installable onto the toner hopper for supplying toner to the developing unit in a xerographic image forming device is composed of a casing containing toner and having at least one toner discharge opening; a sealing film having a sealing portion peel-separably affixed to the casing in the vicinity of the toner discharge opening for sealing the opening, as well as a peel-separating leader portion extending beyond the toner discharge opening from one end of the sealing portion and lapping toward an opposite end of the sealing portion. Therein, the sealing film overlaps itself and has open opposite lateral edges, and furthermore is withdrawable in a direction away from the opposite end of the sealing portion. The toner cartridge further includes retaining elements affixed to the casing for covering the open opposite lateral edges of the sealing film.

The configuration of the toner cartridge further includes an installation seat for fixably accommodating the end of the casing having the toner discharge opening. The installation seat has at a toner-disgorging opening corresponding to the toner discharge opening in the casing.

Furthermore, the toner cartridge configuration can include a sealing-film cleaning element provided over the peel-separating leader portion of the sealing film, separated from the casing by a distance predetermined for effectively removing toner coming into contact with and clinging superficially to the sealing portion as it is peeled away from the casing.

Still further, the toner cartridge configuration can include a sealing film peel-separating mechanism for withdrawing and reeling the peel-separating leader portion of the sealing film, whereby the sealing portion is peeled away from the casing.

A toner cartridge in another aspect of the present invention is composed of a casing containing toner and having at least one toner discharge opening; a sealing film having a sealing portion peel-separably affixed to the casing in the vicinity of the toner discharge opening for sealing the opening, as well as a peel-separating leader portion extending beyond the toner discharge opening from one end of the sealing portion and lapping toward an opposite end of the sealing portion. Therein, the sealing film overlaps itself and has open opposite lateral edges, and furthermore is withdrawable in a direction away from the opposite end of the sealing portion.

The toner cartridge includes retaining elements affixed to the casing for covering the open opposite lateral edges of the sealing film, and further includes pressing elements disposed over the retaining elements for maintaining external pressure on the retaining elements wherein the retaining elements cover the open opposite lateral edges of the sealing film.

The configuration of the toner cartridge further includes an installation seat for fixably accommodating the end of the casing having the toner discharge opening. The installation seat has at a toner-disgorging opening corresponding to the toner discharge opening in the casing. Therein, the pressing elements are provided along inward edges of the toner-disgorging opening. The pressing elements can be composed of elastic material.

Furthermore, the toner cartridge configuration can include the sealing-film cleaning element provided on the installation seat lengthwise along the toner-disgorging opening and riding on the peel-separating leader portion of the sealing film. The sealing-film cleaning element is thereby separated from the casing by the above-mentioned distance predetermined for effectively removing toner coming into contact with and clinging superficially to the sealing portion as it is peeled away from the casing.

The sealing film peel-separating mechanism of the toner cartridge in accordance with the present aspect of the invention can be mounted on the installation seat beyond the sealing-film cleaning element in the direction away from the opposite end of the sealing film. Therein the peel-separating mechanism is for withdrawing and reeling the peel-separating leader portion of the sealing film.

A gas permeable film can be used as the sealing film. Moreover, the retaining elements can suitably be made from polyethylene terephthalate.

The toner cartridge according to the foregoing aspects of the present invention is fitted such that the toner discharge opening faces into the toner hopper. When the peeling leader portion of the sealing film is withdrawn, the sealing portion is peeled away from the casing and the toner stored inside it is supplied into the toner hopper. Herein, the open opposite lateral edges of the sealing film are covered by the retaining elements, preventing toner from invading the gap between the overlapping portions of the sealing film. Thus, faulty peeling away of the sealing film can be prevented, and scattering of toner when the sealing film has been completely peeled off can be prevented.

In particular, wherein the toner cartridge or toner hopper is equipped with a film cleaning element, although faulty peeling away would otherwise be liable to occur due to invasion of toner into the gap between the overlapping portions of the sealing film, this can be prevented.

These and other objects, features, aspects and advantages of the present invention will become more fully apparent from the following detailed description of the present invention when taken in conjunction with the accompanying drawings, where like reference numerals denote corresponding parts throughout, in which:

DETAILED DESCRIPTION OF THE PREFERRED EMBODIMENTS

Figure 1:
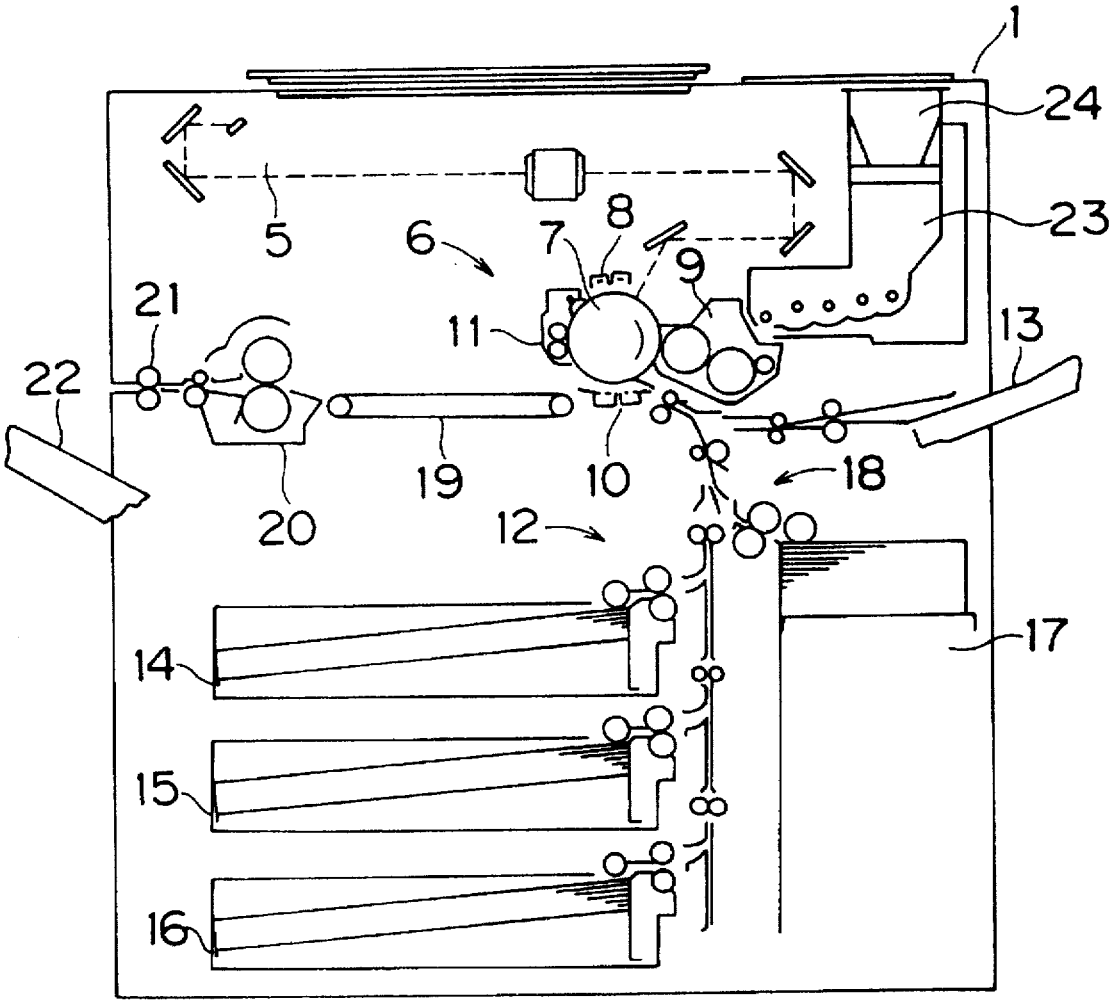
FIG. 1 is a schematic elevational section view of a xerographic photocopier employing an embodiment of the present invention.

Reference is made to FIG. 1, which in an elevational section schematically depicts a xerographic photocopier employing an embodiment in accordance with the present invention.

As shown in FIG. 1, the upper portion of photocopier 1 is provided with exposing station 5 for scanning an original document. Exposing station 5 comprises, inter alia, a light source, mirrors and a lens unit. Further, in the central portion of the photocopier 1, image forming station 6 is provided for forming a toner image of the scanned original document. Image forming station 6 includes photosensitive drum 7 on the surface of which an electrostatic latent image is formed in accordance with the scanned original document. A charging device 8, a developing unit 9, a transfer device 10 and a cleaning device 11 are positioned surrounding photosensitive drum 7.

Sheet supply section 12 is provided in a lower portion of photocopier 1. Sheet supply section 12 consists of bypass table 13 provided on the right side of the photocopier 1 in FIG. 1, three sheet supply cassettes 14, 15 and 16 arranged in a vertical stack, over-sized sheet supply cassette 17, and sheet feed device 18 for transferring sheets held on bypass table 13 or in sheet supply cassettes 14 through 17 to the image forming station 6. On the downstream side of image forming station 6 in the sheet-feeding direction are provided sheet discharging transport path 19, for transporting sheets to the left side of the apparatus in FIG. 1; fixing device 20, for fusing a toner image and fixing it onto a sheet; discharge rollers 21 for discharging a sheet during the fixing operation; and discharge tray 22 for receiving sheets.

A toner hopper 23 is attached to the developing unit 9 for supplying toner. A freely attachable/removable toner cartridge 24 is fitted to the toner hopper 23.

Figure 2:
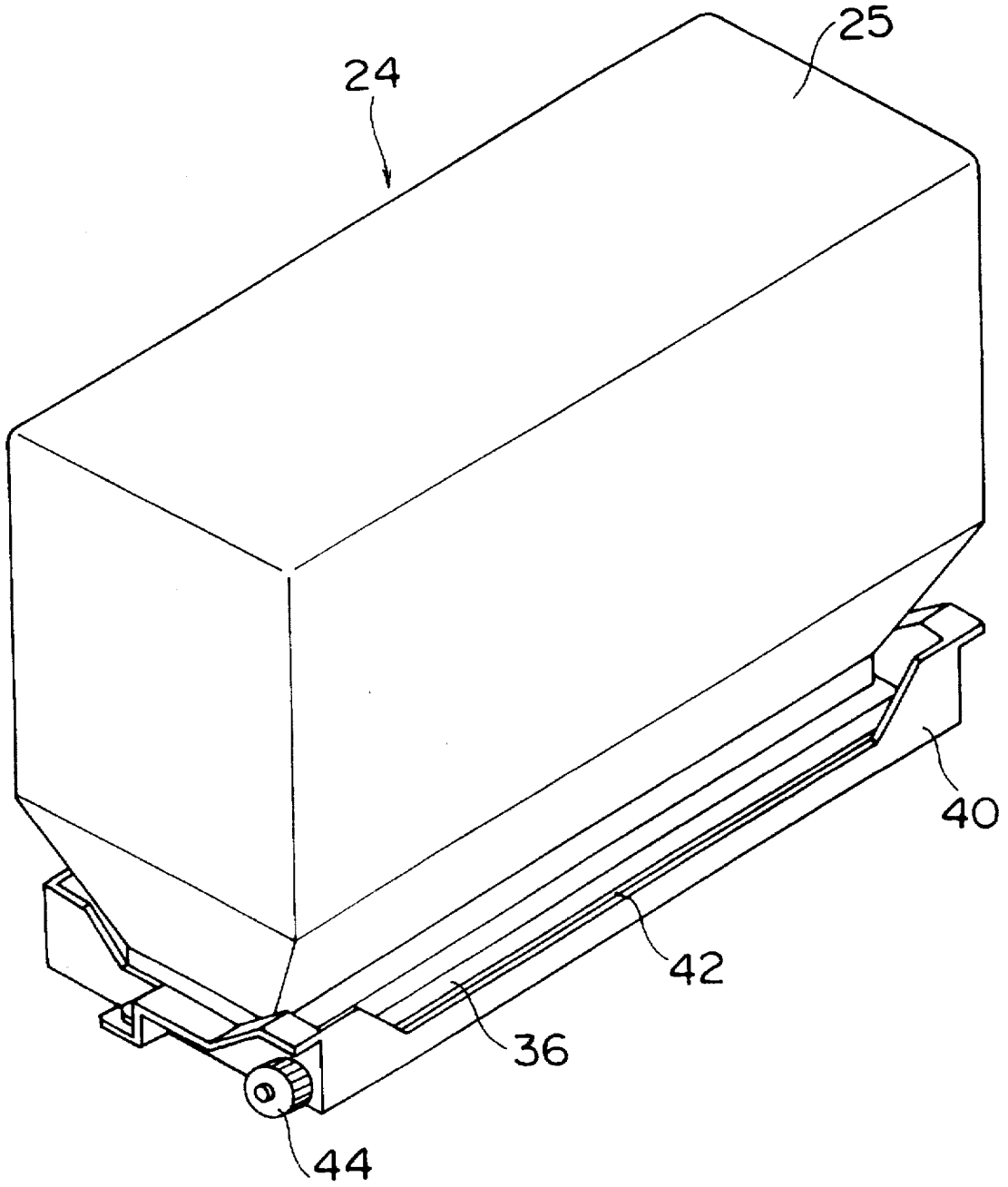
FIG. 2 is an oblique view of a toner cartridge casing fitted to an installation seat in accordance with the present invention.
Figure 3:
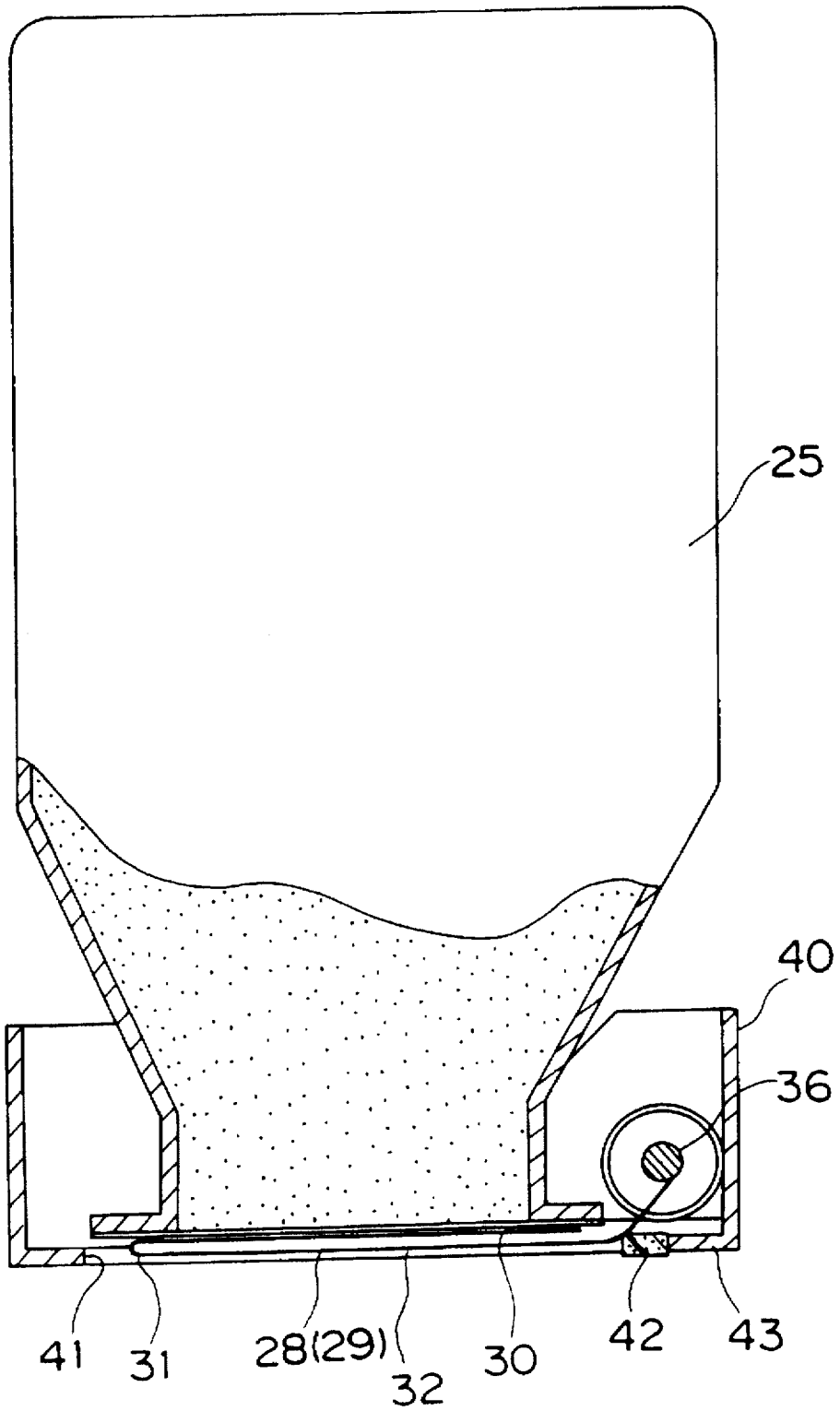
FIG. 3 is a partly in section end view of a toner cartridge in accordance with one embodiment of the present invention.
Figure 4:
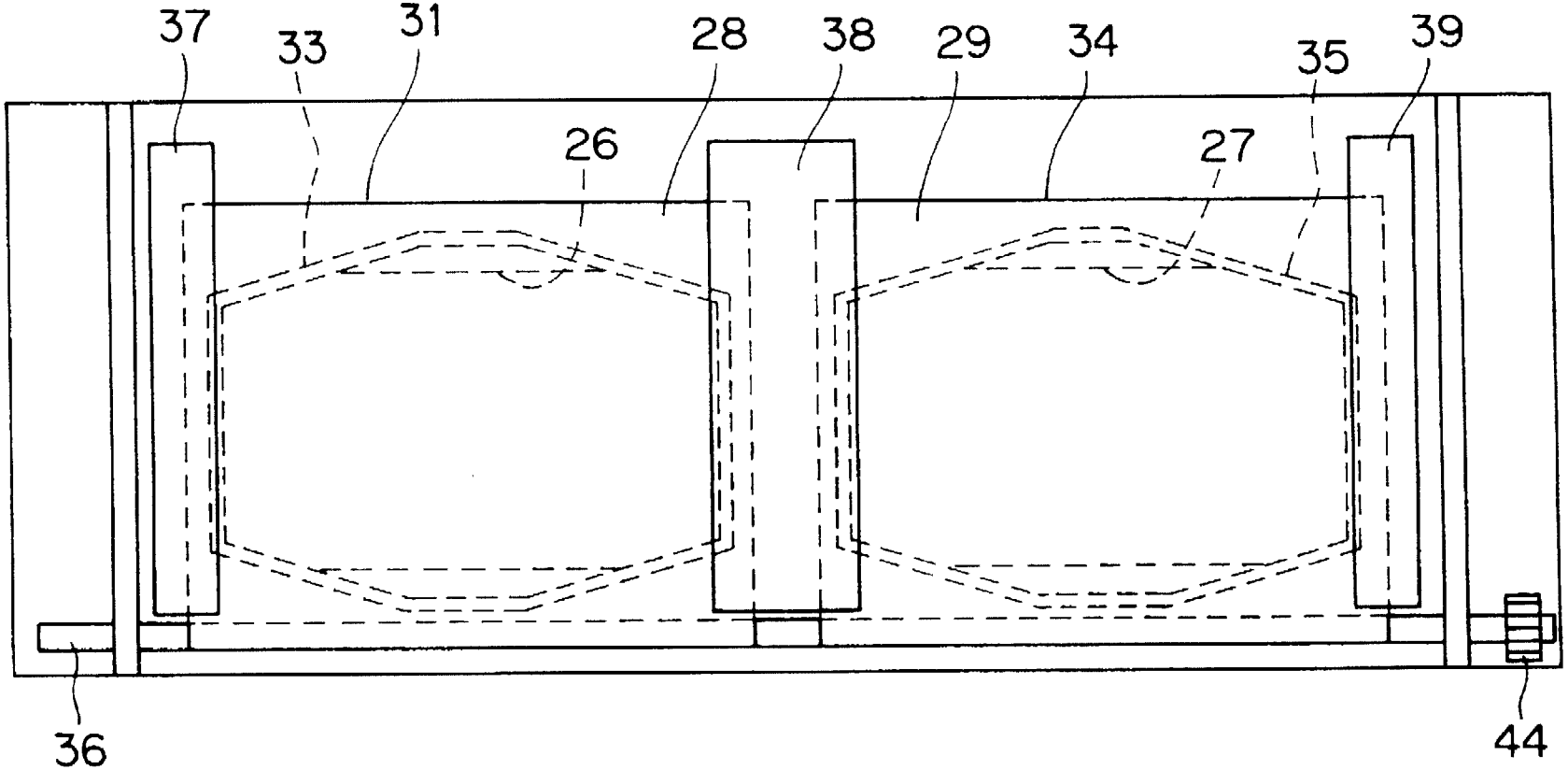
FIG. 4 is a bottom view of the toner cartridge depicted in FIG. 3, shown with the installation seat for the toner cartridge taken off.

An embodiment of the toner cartridge 24 in accordance with the present invention is depicted in FIGS. 2 through 4. The toner cartridge 24 chiefly consists of a rectangular box-like casing 25. The shape of the lower end of the casing 25 is tapered toward the bottom. FIG. 4 shows toner discharge openings 26 and 27 provided in the bottom surface of the casing 25. Sealing films 28 and 29 are attached over the toner discharge openings 26 and 27, respectively.

As shown in FIG. 3, the sealing films 28 and 29 are respectively provided each to include a sealing portion 30 which seals the respective toner discharge openings 26 and 27 and a peel-separating leader 32 which is folded back along respective folds 31 and 34 to overlap the sealing portion 30. The peel-separating leaders 32 are withdrawn to the right in the orientation of FIG. 3. In the orientation of FIG. 4, the sealing films 28 and 29 are accordingly withdrawn downwards.

As shown most clearly in FIG. 4, the sealing portion 30 of the sealing film 28 is peel-separably welded in the vicinity of toner discharge opening 26 through weld 33. Likewise, sealing film 29 provided on toner discharge opening 27 is peel-separably welded to the casing 25 through weld 35. The sealing films 28 and 29 herein consist of a permeable synthetic resin film, and the welds 33 and 35 are fixed to the casing 25 by thermal welding.

A reeling shaft 36, along which the sealing films 28 and 29 extend widthwise, is axially supported by casing 25. The front ends of the sealing films 28 and 29 (i.e., of the respective peel-separating leaders 32) are secured to reeling shaft 36. Therefore, rotating the reeling shaft 36 makes it possible to reel in the sealing films 28 and 29.

Further, the retaining elements 37, 38 and 39 are installed on the bottom surface of casing 25 so as to cover the edges along either side of both sealing films 28 and 29. The left side of retaining element 37 as shown in FIG. 4 is either welded or glued to the lower surface of casing 25. Likewise, the central portion of retaining element 38 and the right side of retaining element 39, respectively, are either welded or glued to the lower surface of casing 25. The retaining elements 37, 38 and 39 are each composed of polyethylene terephthalate or another synthetic resin.

The portions of the retaining elements 37, 38 and 39 which cover sealing films 28 and 29 are free edges left at a clearance from the lower surface of the casing 25 and thus do not obstruct movement of the sealing films 28 and 29. Further-more, the retaining elements 37, 38 and 39 cover the lateral margins of the sealing films 28 and 29 where they overlap, such that invasion of toner into the gap between the overlapping portions is prevented.

Figure 5:
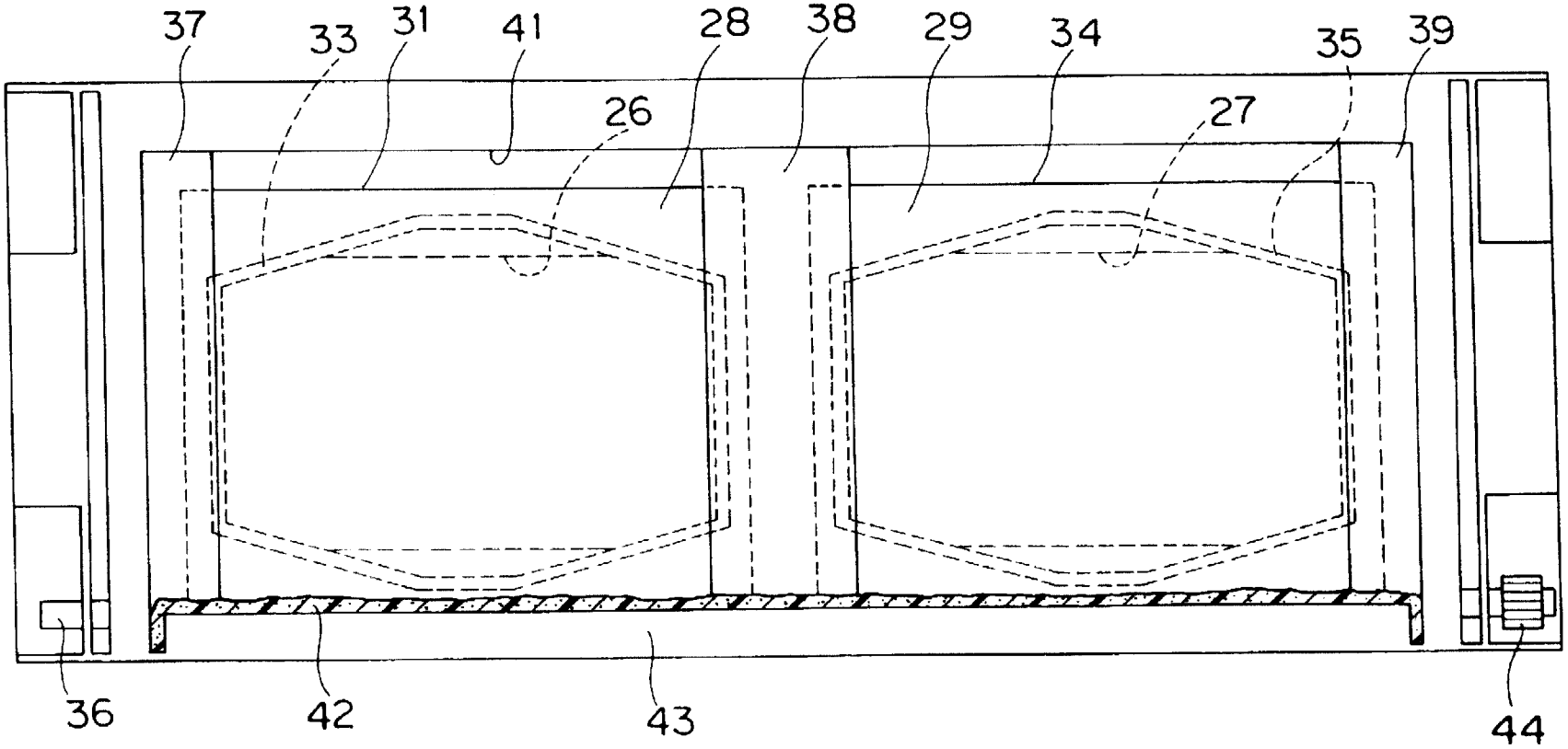
FIG. 5 is another bottom view of the toner cartridge depicted in FIG. 3, shown with the installation seat attached.

An installation seat 40, for fitting the toner cartridge 24 onto the toner hopper 23, is fixed to the bottom end of the casing 25, as illustrated particularly in FIG. 5. An opening 41 which allows the passage of toner exhausted through toner discharge openings 26 and 27 is provided in the bottom surface of installation seat 40. A film cleaning element 42, for removing toner that has come into contact with and clung to the surface of sealing films 28 and 29, is attached to opening 41 in the vicinity of the reeling shaft 36. Film cleaning element 42 is composed of an elastic material such as a foamed synthetic resin and is attached as a band along a flange portion 43 of the installation seat 40.

A drive gear 44 is provided on an end of the reeling shaft 36. The drive gear 44 is rotation-driven by a motor (not illustrated). It is also possible to provide a handle on the reeling shaft 36 by which it can be manually cranked.

With the toner cartridge according to the present embodiment of the invention, since the retaining elements cover the lateral margins of the overlapping portions of the peel-separating leader and the sealing portions of the sealing film, invasion of toner into the gap in the overlapping portions can be prevented. As a result, faulty peeling of the sealing film can be prevented, and scattering of toner when peeling is completed can be prevented.

In particular, wherein the toner cartridge or toner hopper is equipped with a film cleaning element, faulty peel-separation, which might readily occur due to invasion of toner into the sealing film gap, can be prevented.

Figure 6:
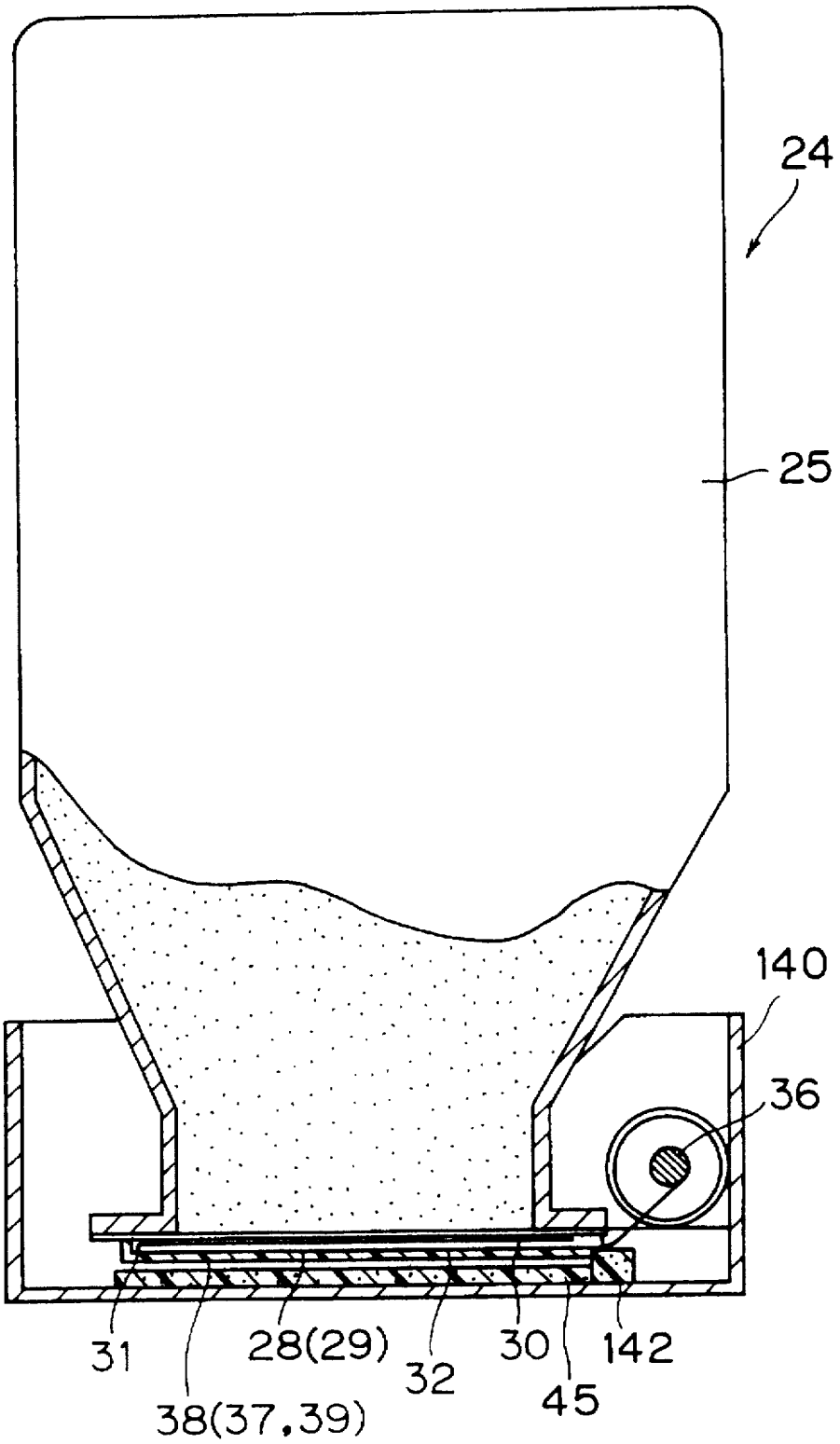
FIG. 6 is a partly in section end view of a toner cartridge in accordance with another embodiment of the present invention.
Figure 7:
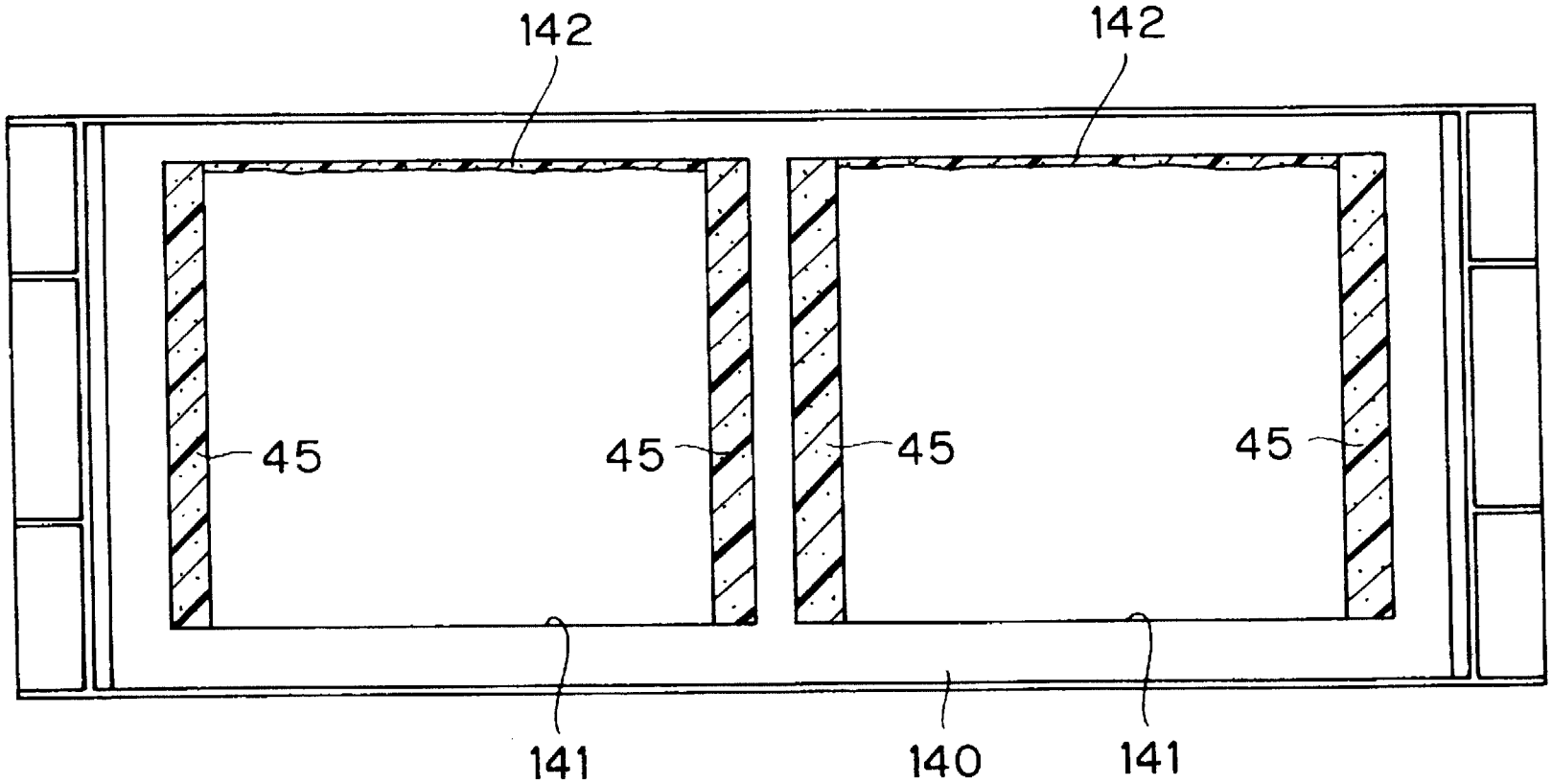
FIG. 7 is a plan view of a toner cartridge installation seat in accordance with the embodiment depicted in FIG. 6.
Figure 8:
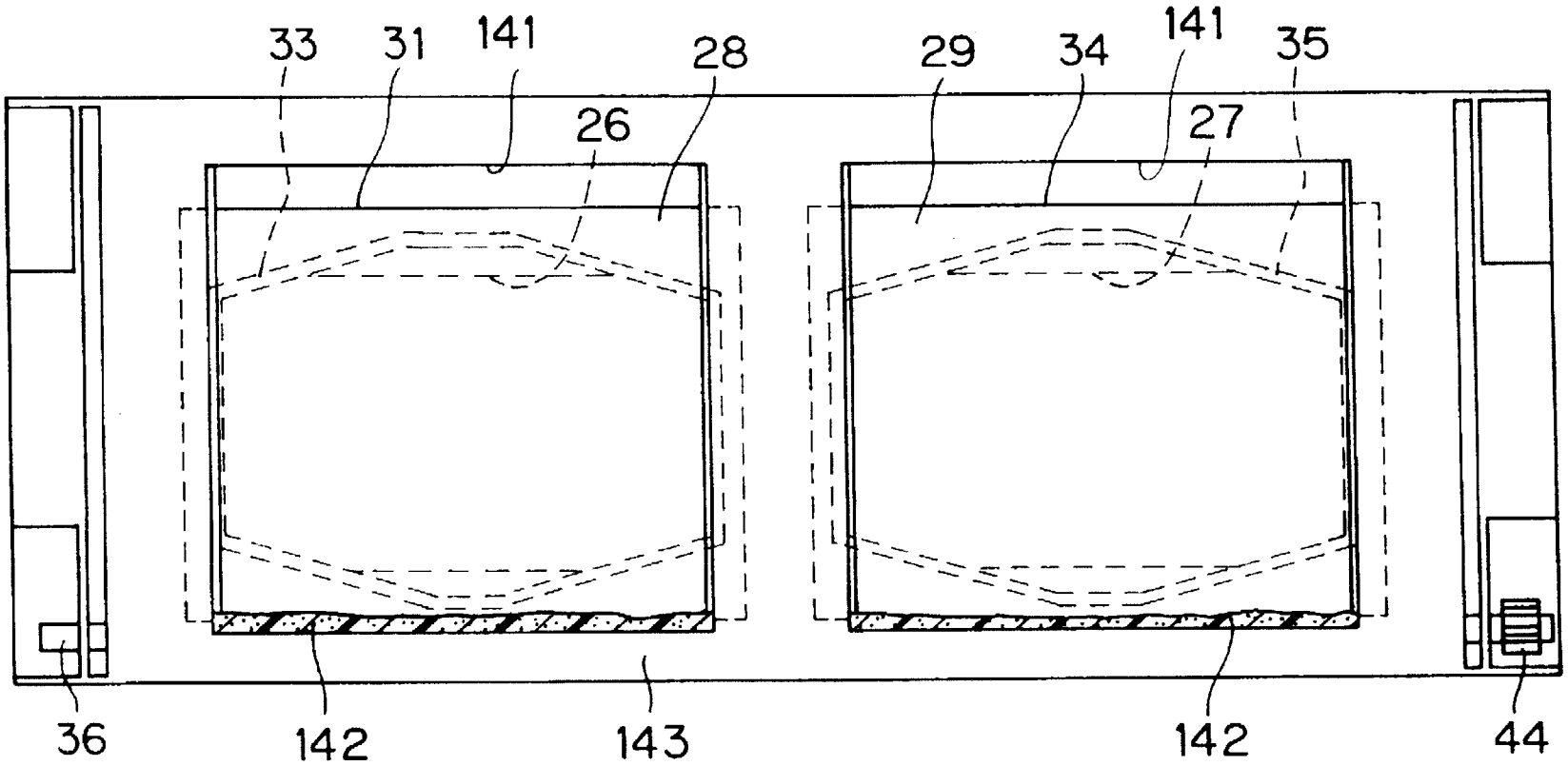
FIG. 8 is a bottom view of the toner cartridge depicted in FIG. 6, shown with the installation seat attached.

Another embodiment of a toner cartridge in accordance with the present invention is illustrated in FIGS. 6 through 8, where like reference numerals denote structural elements and features similar to those correspondingly designated in the description of the foregoing embodiment, hence which description will not be repeated. (Note that the section taken partially through the toner cartridge in the end view of FIG. 5 is through a different plane from that of the partial section of FIG. 3.)

FIG. 7 is a plan view of an installation seat 140 configured in accordance with the present embodiment. As shown in FIG. 7, installation seat 140 is provided with two like openings 141, 141 to allow the passage of toner exhausted from toner discharge openings 26 and 27. Film cleaning elements 142, 142, consisting of an elastic material such as a foamed synthetic resin, are attached as bands to the edges of the openings 141, 141 along a flange portion 143 of the installation seat 140 in the vicinity of reeling shaft 36. The film cleaning elements 142, 142 are thus disposed in contact with the surface of the sealing films 28 and 29 to remove toner.

Along those edges of the openings 141, 141, which are overlapped by retaining elements 37, 38 and 39, pairs of pressuring elements 45, 45 are fitted for controlling outward curling of the retaining elements 37, 38 and 39. Like the pair of film cleaning elements 142, 142, the pairs of pressuring elements 45, 45 can be composed of an elastic material such as a foamed synthetic resin.

FIG. 8 shows a bottom view of installation seat 140 affixed to the toner cartridge casing 25. The pressuring elements 45, 45 hereby apply pressure to the portions forming the free edges of retaining elements 37, 38 and 39, and prevent the retaining elements 37, 38 and 39 from curling outward.

Alternatively, the pressuring elements 45, 45 can be disposed on a corresponding surface of the toner hopper 23.

Likewise as with the foregoing embodiment, the drive gear 44 provided on an end of the reeling shaft 36 can be rotation-driven by a motor, or it can be manually cranked by a handle provided on the reeling shaft 36.

With the toner cartridge according to the embodiment of the invention just described, the retaining elements are prevented from rising outward by the pressuring elements, thereby making it possible even more reliably to prevent invasion of toner into the gaps along the lateral margins of the overlapping portions of the peel-separating leader and the sealing portions of the sealing film. As a result, faulty peeling of the sealing film can be prevented, as can be scattering of toner when peeling is completed.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A toner cartridge for a developing unit in a xerographic image forming apparatus, comprising:

a casing having at least one toner discharge opening, the discharge opening being defined by a rim of said casing; and retaining elements each partially affixed to said rim edgewise leaving a clearance from said rim, said retaining elements therein for covering open opposite lateral edges of an overlapped sealing film.

2. A toner cartridge according to claim 1, further comprising pressing elements disposed over said retaining elements for maintaining external pressure on said retaining elements wherein said retaining elements cover open opposite lateral edges of a sealing film.

3. A toner cartridge according to claim 1, further comprising a sealing film having a sealing portion affixed to said rim with ability to be peeled away therefrom, and a peeling leader portion extending beyond said toner discharge opening from one end of said sealing portion and lapping toward an opposite end of said sealing portion; wherein said sealing film overlaps itself and has open opposite lateral edges, and said sealing film is withdrawable in a direction away from said opposite end, and the clearances between said retaining elements and said rim accommodate edgewise said open opposite lateral edges of said sealing film.

4. A toner cartridge according to claim 3, further comprising a sealing-film cleaning element provided along said rim separated from said rim by a predetermined distance.

5. A toner cartridge according to claim 4, further comprising a mechanism having means for peeling and reeling said sealing film away from said toner discharge opening.

6. A toner cartridge installable onto a toner hopper for supplying toner in a xerographic image forming apparatus, the toner cartridge comprising:

a casing containing toner, said casing having at least one toner discharge opening;

a sealing film having a sealing portion for sealing said toner discharge opening, said sealing portion being peel-separably affixed to said casing proximate said toner discharge opening, and a peel-separating leader portion extending beyond said toner discharge opening from one end of said sealing portion and lapping toward an opposite end of said sealing portion, wherein said sealing film overlaps itself and has open opposite lateral edges, and said sealing film is withdrawable in a direction away from said opposite end; and retaining elements affixed to said casing for covering said open opposite lateral edges of said sealing film.

7. A toner cartridge according to claim 6, further comprising means for withdrawing said sealing film away from said toner discharge opening.

8. A toner cartridge according to claim 7, further comprising a sealing-film cleaning element provided over said peel-separating leader portion of said sealing film, separated from said casing by a distance predetermined for effectively removing toner coming into contact with and clinging superficially to said sealing portion as said sealing film is peeled away from said casing.

9. A toner cartridge according to claim 8, wherein said means for withdrawing said sealing film comprises a mechanism having a rotatable shaft connected to said peel-separating leader portion for peeling and reeling said sealing film away from said toner discharge opening.

10. A toner cartridge according to claim 6, wherein said sealing film is a gas permeable film.

11. A toner cartridge according to claim 6, wherein said retaining elements are formed of polyethylene terephthalate.

12. A toner cartridge installable onto a toner hopper for supplying toner to a developing unit in a xerographic image forming apparatus, the toner cartridge comprising:

a casing containing toner, said casing having at least one toner discharge opening in a surface thereof directed toward exhausting the toner wherein the toner cartridge is installed onto a toner hopper;

a sealing film having a sealing portion for sealing said toner discharge opening, said sealing portion being peel-separably affixed to said casing proximate said toner discharge opening, and a peel-separating leader portion extending beyond said toner discharge opening from one end of said sealing portion and lapping toward an opposite end of said sealing portion, wherein said sealing film overlaps itself and has open opposite lateral edges, and said sealing film is withdrawable in a direction away from said opposite end;

retaining elements affixed to said casing for covering said open opposite lateral edges of said sealing film; and pressing elements disposed over said retaining elements for maintaining external pressure on said retaining elements wherein said retaining elements cover said open opposite lateral edges of said sealing film.

13. A toner cartridge according to claim 12, further comprising an installation seat for fixably accommodating said surface of said casing, said installation seat having at least one toner-disgorging opening corresponding to said toner discharge opening, wherein said pressing elements are provided along inward edges of said toner-disgorging opening.

14. A toner cartridge according to claim 13, further comprising a sealing-film cleaning element provided on said installation seat along said toner-disgorging opening and riding on said peel-separating leader portion of said sealing film, wherein said sealing-film cleaning element is separated from said casing by a distance predetermined for effectively removing toner coming into contact with and clinging superficially to said sealing portion as said sealing film is peeled away from said casing.

15. A toner cartridge according to claim 14, further comprising a sealing film peel-separating mechanism mounted on said installation seat beyond said sealing-film cleaning element in a direction away from said opposite end of said sealing film, said peel-separating mechanism for withdrawing and reeling said sealing film away from said toner discharge opening.

16. A toner cartridge according to claim 12, wherein said sealing film is a gas permeable film.

17. A toner cartridge according to claim 12, wherein said retaining elements are formed of polyethylene terephthalate.

18. A toner cartridge according to claim 12, wherein said pressing elements are composed of elastic material.

* * * * *